US007760196B2

(12) United States Patent
Yoo et al.

(10) Patent No.: US 7,760,196 B2
(45) Date of Patent: Jul. 20, 2010

(54) IMPULSIVE DRIVING LIQUID CRYSTAL DISPLAY AND DRIVING METHOD THEREOF

(75) Inventors: Sang-Wook Yoo, Suwon-si (KR); Cheol-Woo Park, Suwon-si (KR)

(73) Assignee: Samsung Electronics Co., Ltd. (KR)

( * ) Notice: Subject to any disclaimer, the term of this patent is extended or adjusted under 35 U.S.C. 154(b) by 1113 days.

(21) Appl. No.: 11/016,787

(22) Filed: Dec. 20, 2004

(65) Prior Publication Data

US 2005/0162917 A1 Jul. 28, 2005

(30) Foreign Application Priority Data

Dec. 19, 2003 (KR) ..... 10-2003-0093839

(51) Int. Cl.
*G09G 5/00* (2006.01)

(52) U.S. Cl. ..... 345/204; 345/87; 345/89; 345/94; 345/99

(58) Field of Classification Search ..... 345/92, 345/94, 96, 98, 99, 103, 690–964, 90, 87, 345/89

See application file for complete search history.

(56) References Cited

U.S. PATENT DOCUMENTS 6,069,597 A 5/2000 Hansen
6,819,311 B2 * 11/2004 Nose et al. ..... 345/100
7,148,885 B2 * 12/2006 Nose ..... 345/209
2006/0244705 A1 * 11/2006 Song et al. ..... 345/98

FOREIGN PATENT DOCUMENTS

| | | |
|---|---|---|
| CN | 1245823 A | 3/2000 |
| CN | 1396581 | 2/2003 |
| CN | 1565800 | 1/2005 |
| JP | 2000-020028 | 1/2000 |
| JP | 2002-341832 | 11/2002 |

* cited by examiner

*Primary Examiner*—Richard Hjerpe
*Assistant Examiner*—Jennifer T Nguyen
(74) *Attorney, Agent, or Firm*—Cantor Colburn LLP

(57) ABSTRACT

An impulsive driving LCD is provided, which includes: a plurality of groups of gate lines transmitting a gate-on voltage; a plurality of data lines alternately transmitting normal data voltages and an impulsive data voltage; a plurality of pixels arranged in a matrix and including switching elements that are connected to the gate lines and the data lines and turn on in response to the gate-on voltage to transmit the data voltages; a plurality of gate driving circuits connected to respective groups of gate lines and sequentially applying the gate-on voltage to the gate lines; a data driver applying the data voltages to the data lines; and a signal controller controlling the gate driver and the data driver. Each pixel is supplied with the normal data voltages at least twice and with the impulsive data voltage at least once, and the application of the normal voltages are continuously performed without interrupt.

17 Claims, 4 Drawing Sheets

IMPULSIVE DRIVING LIQUID CRYSTAL DISPLAY AND DRIVING METHOD THEREOF

BACKGROUND OF THE INVENTION (a) Field of the Invention

The present invention relates to a liquid crystal display and a driving method thereof, and in particular, to an impulsive driving liquid crystal display and a driving method thereof.

(b) Description of Related Art

A liquid crystal display (LCD) includes a pair of panels provided with field generating electrodes and a liquid crystal (LC) layer having dielectric anisotropy, which is disposed between the two panels. The field generating electrodes generally include a plurality of pixel electrodes arranged in a matrix and connected to switching elements such as thin film transistors (TFTs) to be supplied with data voltages every row and a common electrode covering an entire surface of a panel and supplied with a common voltage. A pair of field generating electrodes that generate the electric field in cooperation with each other and a liquid crystal disposed therebetween form so called a liquid crystal capacitor that is a basic element of a pixel along with a switching element.

The LCD applies the voltages to the field generating electrodes to generate electric field to the liquid crystal layer, and the strength of the electric field can be controlled by adjusting the voltage across the liquid crystal capacitor. Since the electric field determine the orientations of liquid crystal molecules and the molecular orientations determine the transmittance of light passing through the liquid crystal layer, the light transmittance is adjusted by controlling the applied voltages, thereby obtaining desired images.

In order to prevent image deterioration due to long-time application of the unidirectional electric field, etc., polarity of the data voltages with respect to the common voltage is reversed every frame, every row, or every pixel.

The polarity inversion of the data voltages increases the charging time of the liquid crystal capacitor since the response time of the liquid crystal is not so fast. Therefore, it takes long time for the liquid crystal capacitor to reach a target luminance (or target voltage) such that an image displayed by the LCD is unclear and blurred.

In order to solve this problem, impulsive driving that inserts a black image for a short time between normal images is developed.

The impulsive driving includes an impulsive emission type driving that periodically lights off a backlight lamp to yield black images and a cyclic resetting type driving that periodically applies a black data voltage for making the pixels in a black state to the pixels between the applications of normal data voltages.

However, these techniques do not compensate the large response time of the liquid crystal yet and the response time of the backlight lamp is large, too. Therefore, afterimages and flickering are generated to deteriorate image quality. In addition, the cyclic resetting type driving may decrease the time for applying normal data voltages for displaying normal images such that the liquid crystal capacitor do not reach a target luminance.

The decrease of the charging time for normal data voltages may be compensated by precharging the liquid crystal capacitor for a time to reduce the difference between the current luminance and the target luminance, thereby enabling to reach the target luminance for a given time.

In the meantime, the switching elements selectively transmit the data voltages for the liquid crystal capacitors in response to gate signals and thus the LCD includes gate lines for transmitting the gate signals and data lines for transmitting data voltages. The gate signal is a pulse-like signal including a gate-on voltage for turning on the switching elements and a gate-off voltage for turning off the switching elements and the gate signal is generated by a gate driver. The gate driver for a high resolution LCD may include a plurality of gate driving circuits, each gate driving circuit connected to a group of the gate lines. The gate-on voltage is sequentially outputted to the gate lines from a first gate driving circuit, and when the scanning of the gate-on voltage for the gate lines connected to the first gate driving circuit is finished, the first gate driving circuit sends a control signal to a next gate driving circuit to start the scanning of the gate-on voltage.

For precharging and impulsive driving, the gate signal further includes pulses for precharging and for impulsive charging, and the pulses of the gate signal are required to be appropriately arranged. In particular, it is preferable that the scanning of the pulses of the gate signal is smoothly passed between the gate driving circuits so that all the gate lines may transmit the gate signals in a uniform state and all the pixels may display under a uniform condition. When some pixels experience unsatisfied precharging, a transverse stripe may be generated on the positions of the LCD where such pixels are disposed.

SUMMARY OF THE INVENTION

A motivation of the present invention is to solve the problems of conventional techniques.

An impulsive driving liquid crystal display is provided, which includes: a plurality of groups of gate lines transmitting a gate-on voltage; a plurality of data lines alternately transmitting normal data voltages and an impulsive data voltage; a plurality of pixels arranged in a matrix and including switching elements that are connected to the gate lines and the data lines and turn on in response to the gate-on voltage to transmit the data voltages; a plurality of gate driving circuits connected to respective groups of gate lines and sequentially applying the gate-on voltage to the gate lines; a data driver applying the data voltages to the data lines; and a signal controller controlling the gate driver and the data driver, wherein each pixel is supplied with the normal data voltages at least twice and with the impulsive data voltage at least once, and the application of the normal voltages are continuously performed along a column direction without interrupt.

The signal controller may supply a plurality of output enable signals defining duration of the gate-on voltage to respective gate driving circuits. The output enable signal may have a first waveform for blocking the impulsive data voltage and a second waveform for blocking the normal data voltages. Two of the output enable signals that may be supplied to two adjacent gate driving circuits may simultaneously have the first waveform during a predetermined period.

The pixels connected to at least three of the gate lines are simultaneously supplied with the normal data voltages during the predetermined period.

The number of the gate driving circuits may be larger than two and at least two of the output enable signals may have the second waveform during remaining period except for the predetermined period.

The normal data voltages may be supplied with next nearest rows of the pixels.

The normal data voltages may be subjected to dot inversion or row inversion.

The signal controller may supply a scanning start signal instructing to start scanning of the gate-on voltage to one of the gate driving circuits, and the scanning start signal may include normal data pulses for the application of the normal data voltages and impulsive data pulses for the application of the impulsive data voltage.

The impulsive data voltage may include a black data voltage.

An impulsive driving liquid crystal display is provided, which includes: a plurality of groups of gate lines transmitting a gate-on voltage; a plurality of data lines alternately transmitting normal data voltages and an impulsive data voltage; a plurality of pixels arranged in a matrix and including switching elements that are connected to the gate lines and the data lines and turn on in response to the gate-on voltage to transmit the data voltages; a plurality of gate driving circuits connected to respective groups of gate lines and sequentially applying the gate-on voltage to the gate lines; and a data driver applying the data voltages to the data lines, wherein each pixel is supplied with the normal voltages for other pixel, the normal data voltages for itself, and the impulsive data voltage at least once, and at least two pixels connected to different gate driving circuits via the gate lines are simultaneously supplied with the normal data voltages during a predetermined time.

The at least two pixels may include a first pixel supplied with the normal data voltages for itself and a second pixel supplied with the normal data voltages for the first pixel.

The at least two pixels may further include a third pixel connected to one of the gate driving circuits that is connected to the second pixel and supplied with the normal data voltages for the first pixel.

The first and the second pixels may be connected to next nearest gate lines.

Two pixels connected to one of the gate driving circuits through different gate lines may be simultaneously supplied with the normal data voltages or at least one pixel may be supplied with the impulsive data voltage.

A method of impulsive driving a liquid crystal display including a plurality of pixels arranged in a matrix and including switching elements connected to gate lines and data lines using a plurality of gate driving circuits that apply a gate-on voltage for turning on the switching elements to the gate lines is provided, which includes: alternately applying normal data voltages and an impulsive data voltage; applying the gate-on voltage to the gate lines in pairs or more to supply the normal data voltages to the pixels connected thereto; and applying the gate-on voltage to at least one of the gate lines to supply the impulsive data voltage to the pixels connected thereto, wherein two of the gate driving circuits simultaneously apply the gate-on voltage to respective gate lines during a predetermined time to supply the normal data voltages to the pixels connected thereto.

BRIEF DESCRIPTION OF THE DRAWINGS

The present invention will become more apparent by describing embodiments thereof in detail with reference to the accompanying drawing in which.

DETAILED DESCRIPTION OF THE PREFERRED EMBODIMENTS

Figure 1:
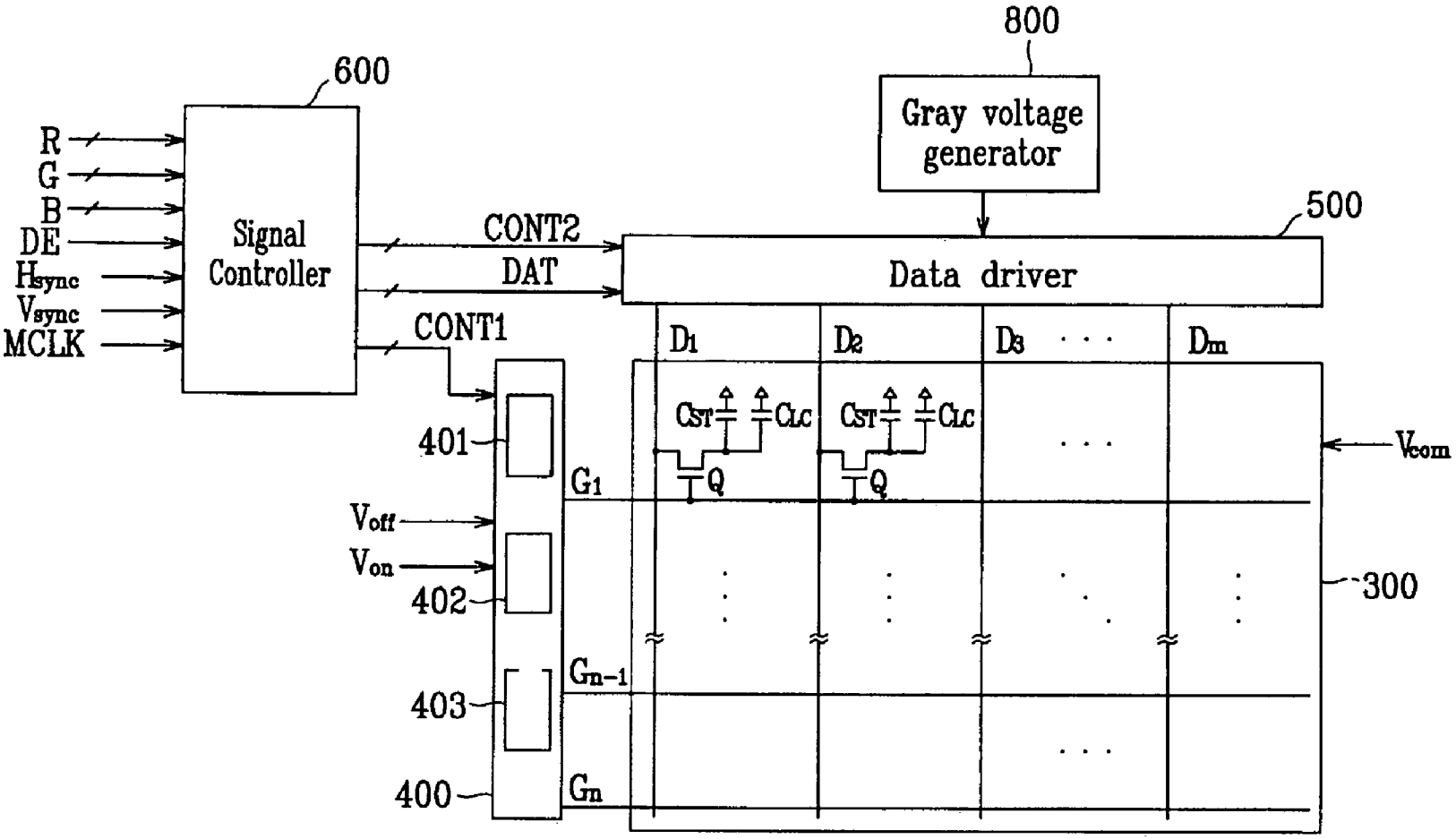
FIG. 1 is a block diagram of an LCD according to an embodiment of the present invention.

The present invention now will be described more fully hereinafter with reference to the accompanying drawings, in which preferred embodiments of the invention are shown.

In the drawings, the thickness of layers and regions are exaggerated for clarity. Like numerals refer to like elements throughout. It will be understood that when an element such as a layer, region or substrate is referred to as being "on" another element, it can be directly on the other element or intervening elements may also be present. In contrast, when an element is referred to as being "directly on" another element, there are no intervening elements present.

Then, liquid crystal displays and driving methods thereof according to embodiments of the present invention will be described with reference to the accompanying drawings.

Figure 2:
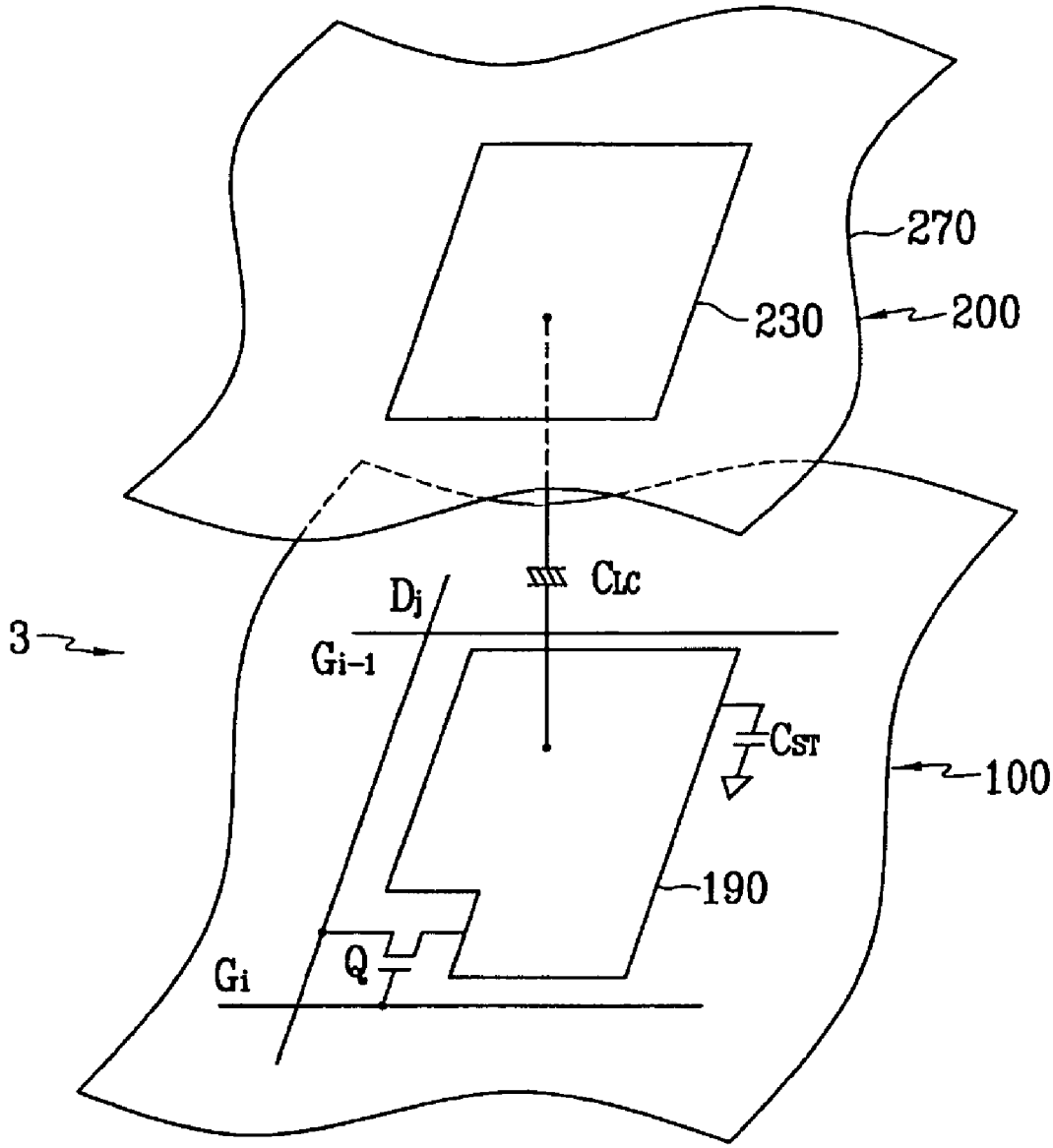
FIG. 2 is an equivalent circuit diagram of a pixel of an LCD according to an embodiment of the present invention.

FIG. 1 is a block diagram of an LCD according to an embodiment of the present invention, and FIG. 2 is an equivalent circuit diagram of a pixel of an LCD according to an embodiment of the present invention.

Referring to FIG. 1, an LCD according to an embodiment includes a LC panel assembly 300, a gate driver 400 and a data driver 500 that are connected to the panel assembly 300, a gray voltage generator 800 connected to the data driver 500, and a signal controller 600 controlling the above elements.

Referring to FIG. 1, the panel assembly 300 includes a plurality of display signal lines $G_1$-$G_n$ and $D_1$-$D_m$ and a plurality of pixels connected thereto and arranged substantially in a matrix. In a structural view shown in FIG. 2, the panel assembly 300 includes lower and upper panels 100 and 200 and a LC layer 3 interposed therebetween.

The display signal lines $G_1$-$G_n$ and $D_1$-$D_m$ are disposed on the lower panel 100 and include a plurality of gate lines $G_1$-$G_n$ transmitting gate signals (also referred to as "scanning signals"), and a plurality of data lines $D_1$-$D_m$ transmitting data signals. The gate lines $G_1$-$G_n$ extend substantially in a row direction and substantially parallel to each other, while the data lines $D_1$-$D_m$ extend substantially in a column direction and substantially parallel to each other.

Each pixel includes a switching element Q connected to the signal lines $G_1$-$G_n$ and $D_1$-$D_m$, and a LC capacitor $C_{LC}$ and a storage capacitor $C_{ST}$ that are connected to the switching element Q. If unnecessary, the storage capacitor $C_{ST}$ may be omitted.

The switching element Q including a TFT is provided on the lower panel 100 and has three terminals: a control terminal connected to one of the gate lines $G_1$-$G_n$; an input terminal connected to one of the data lines $D_1$-$D_m$; and an output terminal connected to both the LC capacitor $C_{LC}$ and the storage capacitor $C_{ST}$.

The LC capacitor $C_{LC}$ includes a pixel electrode 190 provided on the lower panel 100 and a common electrode 270 provided on an upper panel 200 as two terminals. The LC layer 3 disposed between the two electrodes 190 and 270 functions as dielectric of the LC capacitor $C_{LC}$. The pixel electrode 190 is connected to the switching element Q, and the common electrode 270 is supplied with a common voltage Vcom and covers an entire surface of the upper panel 200. Unlike FIG. 2, the common electrode 270 may be provided on the lower panel 100, and both electrodes 190 and 270 may have shapes of bars or stripes.

The storage capacitor $C_{ST}$ is an auxiliary capacitor for the LC capacitor $C_{LC}$. The storage capacitor $C_{ST}$ includes the pixel electrode 190 and a separate signal line, which is provided on the lower panel 100, overlaps the pixel electrode 190 via an insulator, and is supplied with a predetermined voltage such as the common voltage Vcom. Alternatively, the storage capacitor $C_{ST}$ includes the pixel electrode 190 and an adjacent gate line called a previous gate line, which overlaps the pixel electrode 190 via an insulator.

For color display, each pixel uniquely represents one of primary colors (i.e., spatial division) or each pixel sequentially represents the primary colors in turn (i.e., temporal division) such that spatial or temporal sum of the primary colors are recognized as a desired color. An example of a set of the primary colors includes red, green, and blue colors and optionally white (or transparency). Another example of a set of the primary colors includes cyan, magenta, and yellow, which can be employed with or without red, green, and blue colors. FIG. 2 shows an example of the spatial division that each pixel includes a color filter 230 representing one of the primary colors in an area of the upper panel 200 facing the pixel electrode 190. Alternatively, the color filter 230 may be provided on or under the pixel electrode 190 on the lower panel 100.

One or more polarizers (not shown) are attached to at least one of the panels 100 and 200.

Referring to FIG. 1 again, the gray voltage generator 800 generates two sets of a plurality of gray voltages related to the transmittance of the pixels. The gray voltages in one set have a positive polarity with respect to the common voltage Vcom, while those in the other set have a negative polarity with respect to the common voltage Vcom.

The gate driver 400 is connected to the gate lines $G_1$-$G_n$ of the panel assembly 300 and synthesizes the gate-on voltage Von and the gate-off voltage Voff from an external device to generate gate signals for application to the gate lines $G_1$-$G_n$. Referring to FIG. 1, the gate driver 400 includes three gate driving circuits 401-403 and the gate lines $G_1$-$G_n$ are grouped into three groups connected to respective gate driving circuits 401-403. The number of the gate driving circuits may be varied.

The data driver 500 is connected to the data lines $D_1$-$D_m$ of the panel assembly 300 and applies data voltages, which are selected from the gray voltages supplied from the gray voltage generator 800, to the data lines $D_1$-$D_m$. The data driver 500 includes at least one unit circuit (not shown).

The gate driving circuits 401-406 of the gate driver 400 or the data driving circuit of the data driver 500 may be implemented as integrated circuit (IC) chip mounted on the panel assembly 300 or on a flexible printed circuit (FPC) film in a tape carrier package (TCP) type, which are attached to the LC panel assembly 300. Alternately, the drivers 400 and 500 may be integrated into the panel assembly 300 along with the display signal lines $G_1$-$G_n$ and $D_1$-$D_m$ and the TFT switching elements Q.

The signal controller 600 controls the gate driver 400 and the gate driver 500.

Now, the operation of the above-described LCD will be described in detail.

The signal controller 600 is supplied with input image signals R, G and B and input control signals controlling the display thereof such as a vertical synchronization signal Vsync, a horizontal synchronization signal Hsync, a main clock MCLK, and a data enable signal DE, from an external graphics controller (not shown). After generating gate control signals CONT1 and data control signals CONT2 and processing the image signals R, G and B suitable for the operation of the panel assembly 300 on the basis of the input control signals and the input image signals R, G and B, the signal controller 600 transmits the gate control signals CONT1 to the gate driver 400, and the processed image signals DAT and the data control signals CONT2 to the data driver 500.

The image signals DAT includes normal data generated depending on the input image signals R, G and B and black data for impulsive driving that make the luminance of the pixels minimum. The normal data and the black data are alternately outputted once for a horizontal period (referred to as "1H" and equal to a period of the horizontal synchronization signal Hsync or the data enable signal DE).

The gate control signals CONT1 include a scanning start signal STV for instructing to start scanning, a gate clock signal CPV for controlling the output time of the gate-on voltage Von, and a plurality of output enable signals OE1-OE3 (shown in FIG. 3) for defining the duration of the gate-on voltage Von.

The data control signals CONT2 include a horizontal synchronization start signal STH for informing of start of data transmission for a group of pixels, a load signal LOAD for instructing to apply the data voltages to the data lines $D_1$-$D_m$, and a data clock signal HCLK. The data control signal CONT2 may further include an inversion signal RVS for reversing the polarity of the data voltages (with respect to the common voltage Vcom).

Responsive to the data control signals CONT2 from the signal controller 600, the data driver 500 receives a packet of the normal data or the black data for the group of pixels from the signal controller 600, converts the normal data or the black data into analog data voltages selected from the gray voltages supplied from the gray voltage generator 800, and applies the data voltages to the data lines $D_1$-$D_m$.

The gate driver 400 applies the gate-on voltage Von to the gate line $G_1$-$G_n$ in response to the gate control signals CONT1 from the signal controller 600, thereby turning on the switching elements Q connected thereto. The data voltages applied to the data lines $D_1$-$D_m$ are supplied to the pixels through the activated switching elements Q.

The difference between the data voltage and the common voltage Vcom is represented as a voltage across the LC capacitor $C_{LC}$, which is referred to as a pixel voltage. The LC molecules in the LC capacitor $C_{LC}$ have orientations depending on the magnitude of the pixel voltage, and the molecular orientations determine the polarization of light passing through the LC layer 3. The polarizer(s) converts the light polarization into the light transmittance.

By repeating this procedure by a unit of the horizontal period, all gate lines $G_1$-$G_n$ are sequentially supplied with the gate-on voltage Von during a frame, thereby applying the data voltages to all pixels. When the next frame starts after finishing one frame, the inversion control signal RVS applied to the data driver 500 is controlled such that the polarity of the data voltages is reversed (which is referred to as "frame inversion"). The inversion control signal RVS may be also controlled such that the polarity of the data voltages flowing in a data line in one frame are reversed (for example, line inversion and dot inversion), or the polarity of the data voltages in one packet are reversed (for example, column inversion and dot inversion).

Next, an impulsive driving of an LCD according to an embodiment of the present invention will be described in detail with reference to FIGS. 3A and 3B.

Figure 3A:
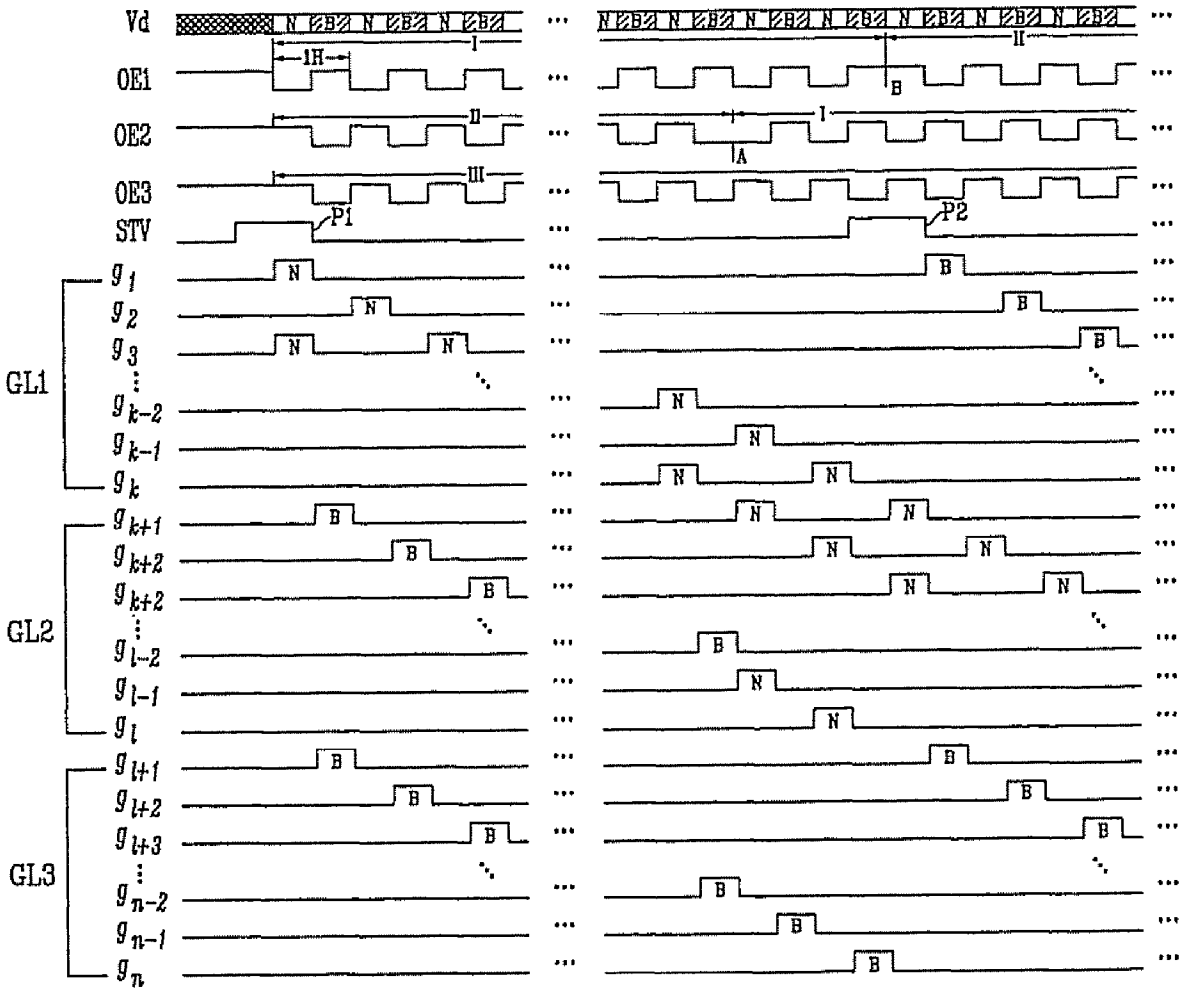
FIGS. 3A and 3B illustrate waveforms of various signals for an LCD according to an embodiment of the present invention.
Figure 3B:
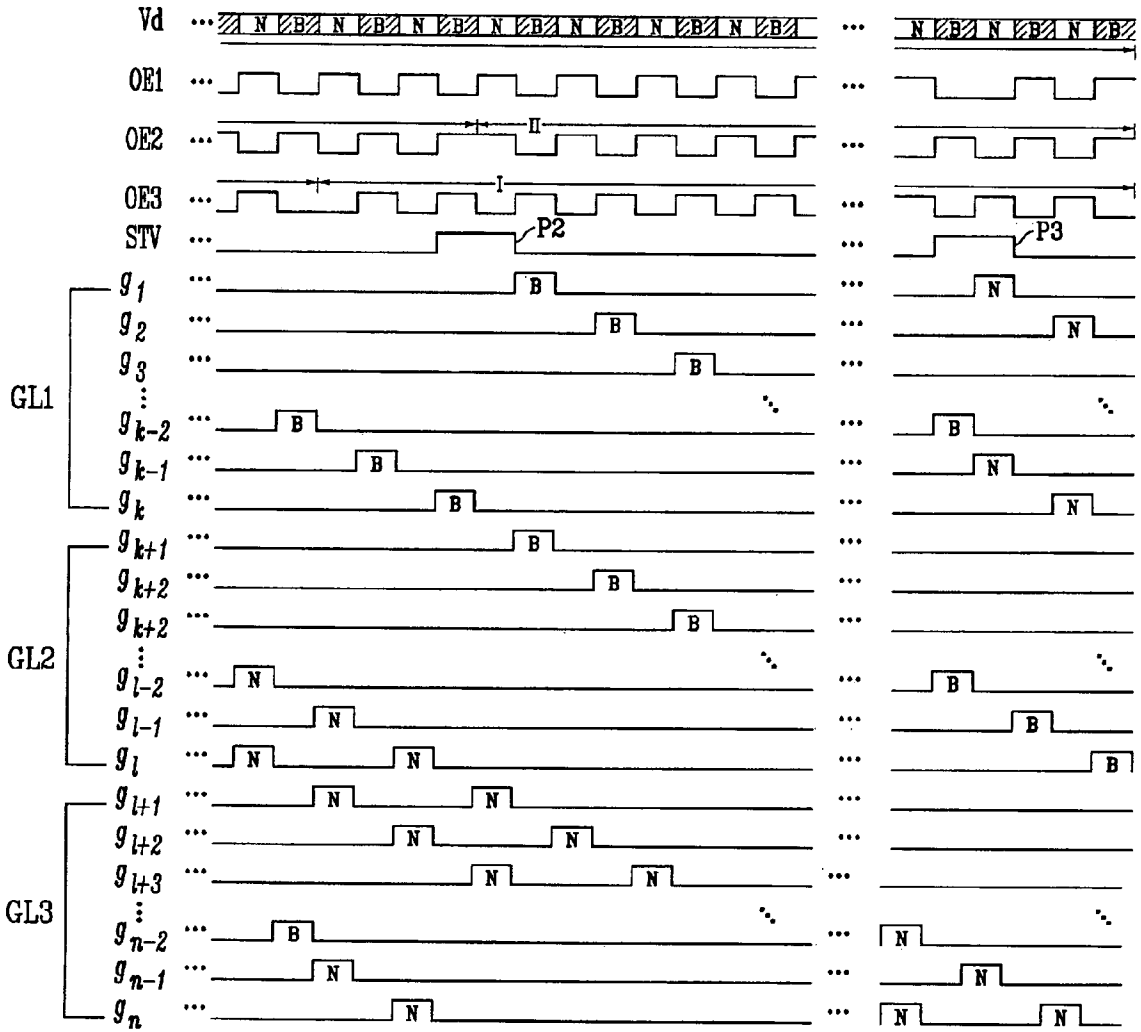

FIGS. 3A and 3B show waveforms of various signals for an LCD according to an embodiment of the present invention, which includes a data voltage Vd, output enable signals OE1-OE3, a scanning start signal STV, and gate signals $g_1$-$g_n$.

As described above, the signal controller 600 supplies image data DAT including normal data and black data to the data driver 500 in an alternate manner, and it also supplies a scanning start signal STV, output enable signals OE1-OE3, and a gate clock signal CPV to the gate driver 400 to perform scanning.

In FIGS. 3A and 3B, the data voltage Vd includes a normal data voltages N corresponding to the normal data and a black data voltage B corresponding to the black data. The normal data voltages N precede the black data voltage B and the sum of the duration of a normal data voltage N and the duration of the black data voltage B equal to 1H. The ratio of the durations of the voltages N and B can be adjusted as required. The inversion type of the data voltage Vd may be one dot inversion or row inversion.

The scanning start signal STV includes normal data pulses P1 for the normal data and black data pulses P2 for the black data and it further includes precharging pulses P3 for precharging for compensating the decrease of the charging time for the normal data due to impulsive driving. The black data pulses P2 are separated from the normal data pulses P1 by ⅓ vertical period or ⅓ frame and two black data pulses P2 are generated in a frame. The interval between the precharging pulse P3 and the normal data pulse P1 is determined so that the precharging voltage may have the same polarity as main charging voltage and the interval may be varied depending on the inversion type. FIGS. 3A and 3B show that the precharging pulse P3 precedes the normal data pulse P1 by two horizontal periods, which can be adaptable to dot inversion or row inversion. Since the dot inversion and the row inversion reverse the polarity of the data voltage Vd every row, the interval between the precharging pulse P3 and the normal data pulse P1 may be even number times of one horizontal period. However, since it is preferable that the interval is short, the interval is determined to be equal to two horizontal periods.

The three output enable signals OE1-OE3 are provided for respective gate driving circuits 401-403 to limit the duration of the gate-on voltage Von outputted from the gate driving circuits 401-403. Each of the output enable signals OE1-OE3 has two waveforms including a normal data waveform I and a black data waveform II, which alternate at appropriate times under the control of the signal controller 600, and the two waveforms I and II are reversed to form each other and have a period equal to one horizontal period. As shown in FIGS. 3A and 3B, a high level of the output enable signals OE1-OE3 represses the output of the gate-on voltage Von to make the gate-off voltage Voff output, while a lower level thereof enables to output the gate-on voltage Von. The ratio of the durations of the high level and the low level of the output enable signals OE1-OE3 is adjusted depending on the ratio of the duration of the normal data voltage N and the duration of the black data voltage B and the high level and the low level may perform exchanged functions.

The above-described operation will be described more in detail.

First, the signal controller 600 generates a precharging pulse P3 at the scanning start signal STV supplied to the first gate driving circuit 401.

When a predetermined time such as two horizontal periods elapses after the generation of the precharging pulse P3, the signal controller 600 generates a normal data pulse P1 at the scanning start signal STV. At this time, the first output enable signal OE1 applied to the first gate driving circuit 401 by the signal controller 600 has the normal data waveform I, while the second and the third output enable signals OE2 and OE3 applied to the second and the third gate driving circuits 402 and 403 have the black data waveform II.

After receiving the pulses P3 and P1 of the scanning start signal STV, the first gate driving circuit 401 sequentially outputs the gate-on voltage Von, which maintains a duration within the duration of the normal data voltage N according to the output enable signal OE1, from a gate line $G_1$ connected to a first output terminal thereof. Since the interval between the precharging pulse P3 and the normal data pulse P1 is equal to 2H, a pair of next nearest gate lines are simultaneously supplied with the gate-on voltage Von. That is, the first and the third gate lines $G_1$ and $G_3$, the second and the fourth gate lines $G_2$ and $G_4$, and so on are supplied with the gate-on voltage Von in pairs. The pixels connected to an earlier one of each pair of the gate lines $G_1$-$G_n$ are subjected to main charging for charging their own data voltages, while the pixels connected to a later one of each pair of the gate lines $G_1$-$G_n$ are subjected to precharging for charging data voltages for other pixels in another row.

The second and the third gate driving circuits 402 and 403 sequentially output the gate-on voltage Von, which maintain a duration within the duration of the black data voltage B according to the output enable signals OE2 and OE3, from gate lines $G_{k+1}$ and $G_{l+1}$ connected to first output terminals thereof.

In this way, the first gate driving circuit 401 continues to scan and, at a time A, it outputs the gate-on voltage Von to the (k−2)-th gate line $G_{k-2}$ for main charging and to the k-th gate line $G_k$ connected to its last output terminal for precharging. Then, the first gate driving circuit 401 outputs a carry signal to the second gate driving circuit 402. At this time, the second gate driving circuit 402 have finished the output of the gate-on voltage Von for the black data to the (k−2)-th gate line $G_{k-2}$.

At the time A, the signal controller 600 changes the waveform of the output enable signal OE2, which is supplied to the second gate driving circuit 402, from the black data waveform II into the normal data waveform I. However, the waveforms of the output enable signals OE1 and OE3 supplied to the first and the third gate driving circuits 401 and 403 are maintained. Accordingly, the output enable signal OE1 for the first gate driving circuit 401 and the output enable signal OE2 for the second gate driving circuit 402 have the normal data waveform I.

Then, the second gate driving circuit 402 outputs the gate-on voltage Von for the normal data to the gate line $G_{k+1}$ connected to its first output terminal and to the gate line $G_{l-1}$ connected to the (l−1)-th output terminal. Thereafter, the second gate driving circuit 402 outputs the gate-on voltage Von for the normal data to the gate lines $G_{k+2}$ and $G_l$ and supplies a carry signal to the third gate driving circuit 403. At this time, the first gate driving circuit 401 outputs the gate-on voltage Von for the normal data to the gate line $G_k$ connected to its last output terminal, and supplies a carry signal to the second gate driving circuit 402. Accordingly, three gate lines connected to the first and the second gate driving circuits 401 and 402 are supplied with the gate-on voltage Von for the normal data during this period. In the meantime, the third gate driving circuit 403 outputs the gate-on voltage Von to the gate line $G_n$ connected to its last output terminal and finishes the scanning.

The signal controller 600 loads a black data pulse P2 on the scanning start signal STV, and, at the time B, it reverses the waveform of the output enable signal OE1 supplied to the first gate driving circuit 401 from the normal data waveform I to the black data waveform II.

The first gate driving circuit 401 receiving the black data pulse P2 of the scanning start signal STV and the third gate driving circuit 403 receiving the carry signal begin scanning the gate-on voltage Von for the black data, while the second gate driving circuit 402 receiving the second carry signal outputs the gate-on voltage Von for the normal data to the gate lines $G_{k+1}$-$G_l$ in pairs.

In this way, pre-charging, main charging, and impulsive charging are appropriately performed.

As described above, the signal controller 600 changes waveforms of the output enable signals OE1-OE3 supplied to respective gate driving circuits 401-403 depending on the application time of the gate-on voltage Von for precharging. That is, when the scanning of the gate-on voltage Von for precharging is passed from one of the gate driving circuits 401-403 to a next one of the gate driving circuits 401-403, the signal controller 600 changes the waveform of one of the output enable signals OE1-OE3 supplied to the next one of the gate driving circuits 401-403, which received the scanning of the gate-on voltage Von for precharging, into the normal data waveform I. This enables all the pixels to be precharged.

The black data voltage B may be substituted with a white data voltage depending on the types of an LCD.

The number of the precharging pulses generated in one frame may be larger than two, and the number of the black data pulses in one frame may be equal to one or more than two.

Although preferred embodiments of the present invention have been described in detail hereinabove, it should be clearly understood that many variations and/or modifications of the basic inventive concepts herein taught which may appear to those skilled in the present art will still fall within the spirit and scope of the present invention, as defined in the appended claims.

What is claimed is:

1. An impulsive driving liquid crystal display comprising:

a plurality of groups of gate lines which transmit a gate-on voltage;

a plurality of data lines which alternately transmit normal data voltages and an impulsive data voltage;

a plurality of pixels arranged in a matrix and each pixel of the plurality of pixels including a switching element connected to a gate line and a data line and which turns on in response to the gate-on voltage to transmit the normal data voltages and the impulsive data voltage;

a plurality of gate driving circuits connected to respective groups of gate lines and which sequentially apply the gate-on voltage to the gate line;

a data driver which applies the normal data voltages and the impulsive data voltage to the data line; and a signal controller which controls a gate driving circuit of the plurality of gate driving circuits and the data driver, wherein at least one pixel of the plurality of pixels is supplied with the normal data voltages at least twice and with the impulsive data voltage at least once, and the application of the normal data voltages to pixels of the plurality of pixels is continuously performed along a substantially column direction without interrupt between gate driving circuits of the plurality of gate driving circuits, and the normal data voltages comprise a data voltage which precharges each pixel.

2. The liquid crystal display of claim 1, wherein the signal controller supplies a plurality of output enable signals defining duration of the gate-on voltage to respective gate driving circuits.

3. The liquid crystal display of claim 2, wherein the output enable signal comprises at least one of a first waveform which blocks the impulsive data voltage and a second waveform which blocks the normal data voltages.

4. The liquid crystal display of claim 3, wherein two of the output enable signals simultaneously have the first waveform during a predetermined period.

5. The liquid crystal display of claim 4, wherein the two of the output enable signals are supplied to two adjacent gate driving circuits.

6. The liquid crystal display of claim 5, wherein the pixels connected to at least three of the gate lines are simultaneously supplied with the normal data voltages during the predetermined period.

7. The liquid crystal display of claim 5, wherein the number of the gate driving circuits is larger than two and at least two of the output enable signals have the second waveform during remaining period except for the predetermined period.

8. The liquid crystal display of claim 7, wherein the normal data voltages are subjected to dot inversion or row inversion.

9. The liquid crystal display of claim 5, wherein the normal data voltages are supplied with next nearest rows of the pixels.

10. The liquid crystal display of claim 1, wherein the signal controller supplies a scanning start signal instructing to start scanning of the gate-on voltage to one of the gate driving circuits, and the scanning start signal includes normal data pulses for the application of the normal data voltages and impulsive data pulses for the application of the impulsive data voltage.

11. The liquid crystal display of claim 1, wherein the impulsive data voltage comprises a black data voltage.

12. An impulsive driving liquid crystal display comprising:

a plurality of groups of gate lines which transmit a gate-on voltage;

a plurality of data lines which alternately transmit normal data voltages and an impulsive data voltage;

a plurality of pixels arranged in a matrix and each pixel of the plurality of pixels including a switching element connected to a gate line and a data line and which turns on in response to the gate-on voltage to transmit the normal data voltages and the impulsive data voltage;

a plurality of gate driving circuits connected to respective groups of gate lines and which sequentially apply the gate-on voltage to the gate line; and a data driver which applies the normal data voltages and the impulsive data voltage to the data line, wherein a first pixel and a second pixel of the plurality of pixels are supplied with a first normal data voltage, a second different normal data voltage, and the impulsive data voltage at least once during a predetermined time, and the first pixel and the second pixel are connected to different gate driving circuits via gate lines and one of the first normal data voltage and the second normal data voltage is a data voltage which precharges each pixel.

13. The liquid crystal display of claim 12, wherein the first pixel is supplied with the first normal data voltage the second pixel is supplied with the first normal data voltage.

14. The liquid crystal display of claim 13, further comprising a third pixel connected to the gate driving circuit connected to the second pixel and supplied with the first normal data voltage and the second different normal data voltage.

15. The liquid crystal display of claim 13, wherein the first and the second pixels are connected to next nearest gate lines.

16. The liquid crystal display of claim 12, wherein two pixels connected to one of the gate driving circuits through different gate lines are simultaneously supplied with the normal data voltages or at least one pixel is supplied with the impulsive data voltage.

17. A method of impulsive driving a liquid crystal display including a plurality of pixels each arranged in a matrix and including switching elements connected to gate lines and data lines using a plurality of gate driving circuits which apply a gate-on voltage for turning on the switching elements to the gate lines, the method comprising:

alternately applying normal data voltages and an impulsive data voltage;

applying the gate-on voltage to the gate lines in pairs or more to supply the normal data voltages to the pixels connected thereto; and applying the gate-on voltage to at least one of the gate lines to supply the impulsive data voltage to the pixels connected thereto, wherein two of the gate driving circuits simultaneously apply the gate-on voltage to respective gate lines during a predetermined time to supply the normal data voltages to the pixels connected thereto, and the normal data voltages comprise a data voltage which precharges each pixel.

* * * * *